United States Patent [19]

Leu

[11] Patent Number: 4,945,279

[45] Date of Patent: Jul. 31, 1990

[54] LAMP APPARATUS FOR GENERATING SEQUENTIAL FLASHES

[76] Inventor: Wen-Fong Leu, 17, 4th Fl., Lane 247, Min-Chuan I Rd., Kaohsiung, Taiwan

[21] Appl. No.: 278,478

[22] Filed: Dec. 1, 1988

[51] Int. Cl.[5] ..... H05B 37/00

[52] U.S. Cl. ..... 315/201; 315/323; 362/806

[58] Field of Search ..... 315/201, 228–232, 315/294, 323; 362/806, 812

[56] References Cited

U.S. PATENT DOCUMENTS 4,713,586 12/1987 Chiang ..... 315/323 X

*Primary Examiner*—Robert J. Pascal

*Attorney, Agent, or Firm*—Bacon & Thomas

[57] ABSTRACT

A xenon lamp apparatus for generating sequential flashes comprises a plurality of sets of lamp units which are connected in series with one another by a socket and a plug which are mounted at either end of each lamp unit. A driving circuit device is preferably provided to actuate an ignition circuit device mounted on a PCB (printed circuit board) within the lamp unit to and send out flashes by control of the driving circuit device. Various flash patterns can be obtained depending on the design of the circuit device.

9 Claims, 9 Drawing Sheets

LAMP APPARATUS FOR GENERATING SEQUENTIAL FLASHES

BACKGROUND OF THE INVENTION

The present invention relates to a lamp apparatus, and more particularly to an apparatus consisting of a plurality of series of arranged flash devices that can generate sequential flashes.

Conventional commercial advertisement lamps are usually made of a plurality of bulbs or Neon tubes electrically connected together to emit light in changeable patterns. The lamps are usually controlled by a central controller to trigger the bulbs in a predetermined sequence. It is found that the electric circuit in a conventional advertisement lamp is very complex due to the large number of bulbs or Neon tubes. Besides, the central controller, which is usually a combination of electrical voltage distributors, which easily malfunctions. It is also noted that known advertisement lamps cannot provide flashes of sufficient strength to attract the attention of passers-by.

SUMMARY OF THE INVENTION

It is therefore the principle object of the present invention to provide a lamp apparatus which can send out very strong flashes in a predetermined time sequence to attract the attention of people for advertisement purposes.

Another object of the present invention is to provide a lamp apparatus which can generate sequential flashes under the control of an electrical circuit device which is simple in structure and maintenance.

An important feature of the lamp apparatus according to the present invention is that each lamp unit has a socket and a plug formed on either end thereof enabling connection between adjacent lamp units.

Another feature of the lamp apparatus according to the present invention is that a seat member is provided to stabilize the whole lamp apparatus.

A further feature of the lamp apparatus according to the present invention is that an ignition circuit device is provided in each lamp unit for starting the flashes of a plurality of Xenon tubes within the each lamp unit.

Yet another feature of the lamp apparatus according to the present invention is that a main driving circuit device is provided for controlling the flash sequence of the Xenon tubes in the different lamp units.

Accordingly, the lamp apparatus of the present invention comprises a plurality of lamp units each having a plug and a socket formed on the respective ends thereof and a plurality of flash tubes installed therein, ignition circuit devices provided in the lamp unit for starting the flash of said flash tubes, and a main driving circuit device for controlling the sequence of flashes of said lamp units.

BRIEF DESCRIPTION OF THE DRAWINGS

These and other advantages, features and objects of the lamp apparatus according to the present invention will become apparent from the following detailed description of a preferred embodiment thereof with reference to the accompanying drawings, wherein.

DETAILED DESCRIPTION OF THE PREFERRED EMBODIMENT

Figure 1:
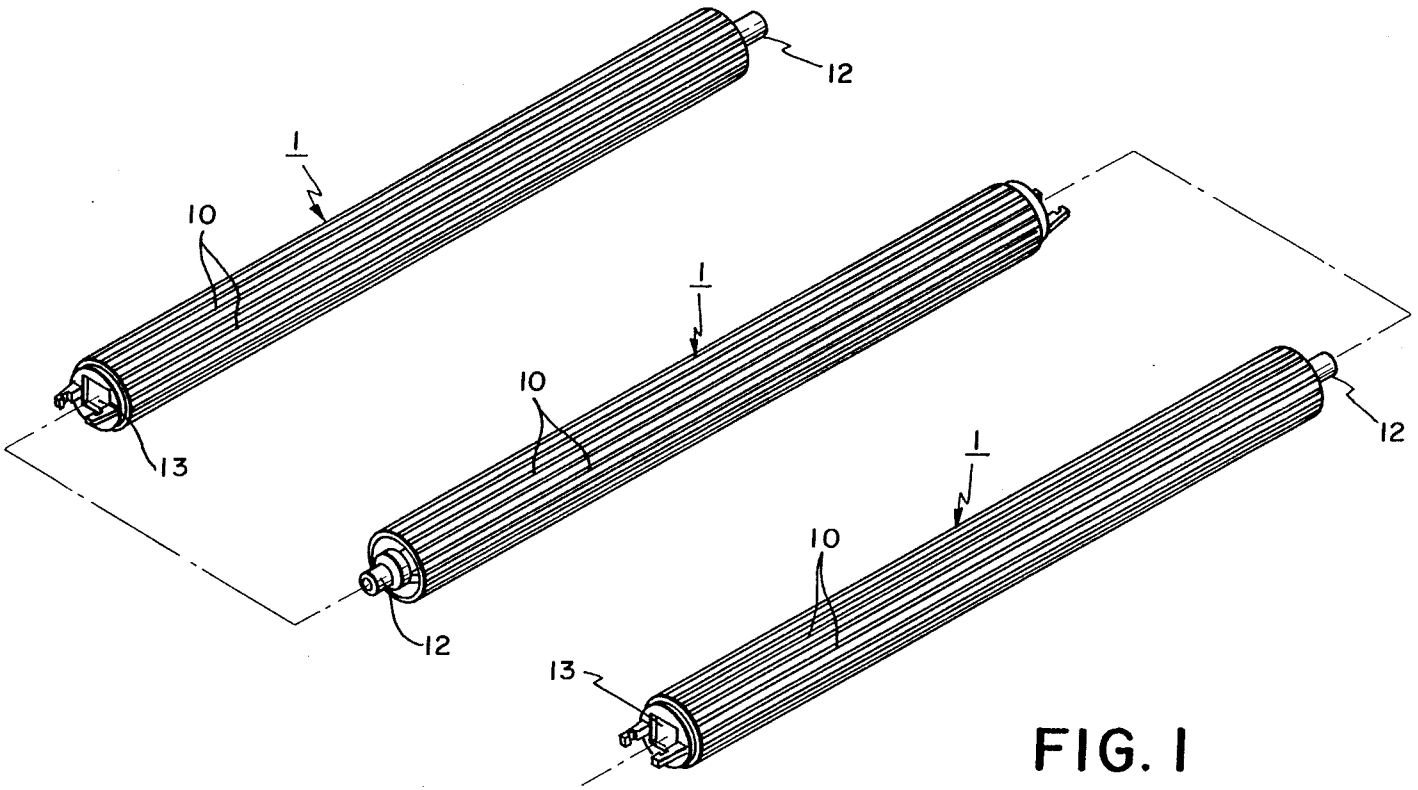
FIG. 1 is a perspective view of the lamp apparatus of the present invention, with lamp units thereof being shown disassembled.

Referring to FIG. 1, a perspective view of the lamp apparatus according to the present invention wherein the lamp apparatus includes a plurality of lamp units 1 shown in a disassembled condition. Each lamp unit 1 has plug 12 and a socket 13 formed on the respective opposite ends thereof. The lamp unit 1 is made of polycarbonate material with the outer cover thereof formed into a desired shape, such as a cylinder. There are protruded stripes 10 formed on the outer cover of the lamp unit 1 for enhancing reflection of the flashes generated by the lamp unit 1.

Figure 2:
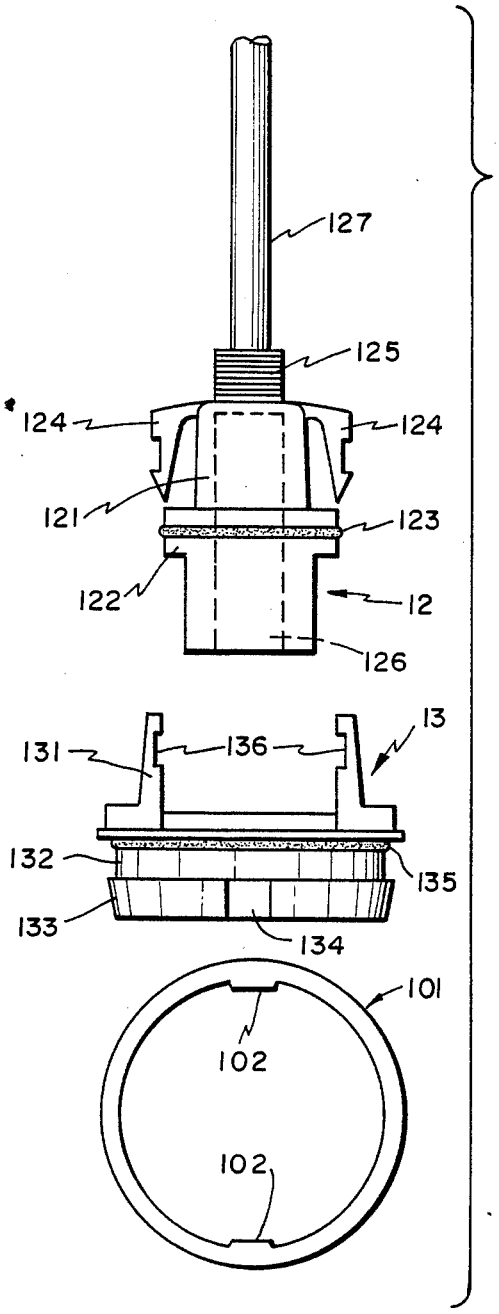
FIG. 2 is an enlarged elevated view of the plug and the socket of the lamp unit.

Referring to FIG. 2 which shows a front view of the plug 12 and the socket 13 of the lamp unit 1, a positioning rim 101 is fixed in the outer cover of the lamp unit 1 at a position close to one end of the lamp unit 1 having a pair of stoppers 102 formed at opposing sides of the rim 101. The socket 13 at one end of the lamp unit 1 includes a cylindrical base 133 having an outer diameter conforming to the inner diameter of the outer cover of the lamp unit 1, a pair of recesses 134 formed on the base 133 for matching the stoppers 102 of the positioning rim 101, a reduced annular portion 132 also formed on the base 133 with a rubber ring 135 sleeved thereon, and a pair of flexible hook members 131 extending radially from said base 133, with each of said hook members 131 having engaging recesses 136 opposing and facing each other. The socket 13 is inserted into the outer cover of the lamp unit 1 at the end thereof, with the positioning rim 101, by aligning the two recesses 134 of the base 133 thereof with the stoppers 102. After insertion, the socket 13 is turned a certain degree. The socket 13 will be connected to the lamp unit 1 due to the flexible nature of the material forming the lamp unit 1 and will also not be released from the lamp unit 1 due to the existence of the stoppers 102 on the positioning rim 101.

The plug 12 has a body 121 which includes an annular flange 122 formed at a central portion thereof and provided with a rubber ring 123 sleeved thereon, a pair of hook members 124 extending axially and surrounding the body 121, and an adaptor 125 which can have outer threads formed thereon. The plug 12 can be connected to one end of the lamp unit 1 with the adaptor 125 thereof in engagement with a pre-installed engaging member within the lamp unit 1. The plug 12 also has a bore 126 formed in the body 121 thereof for the passing through of electric leading wires and an elongated bar 127 extending from the adaptor 125 for the winding of the electric wires and the equipment of the flash units that will be detailed hereinbelow.

Figure 3:
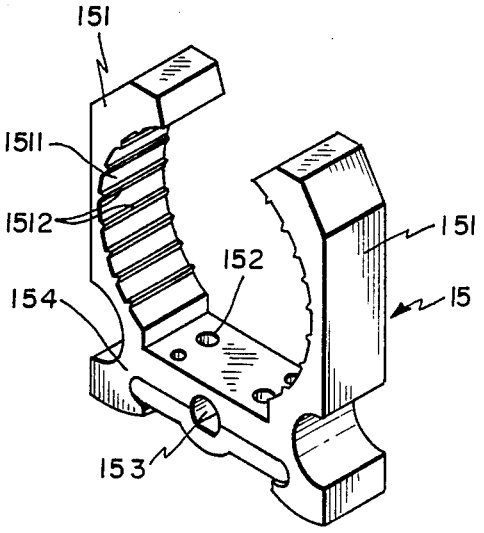
FIG. 3 is a perspective view of a seat member for the lamp apparatus to be attached thereto during the installation of the lamp apparatus.

A seat member 15 for the installation of the lamp apparatus according to the present invention is shown in FIG. 3. The seat member 15 is preferably made of flexible material and comprises a pair of clamp members 151 with curved surfaces 1511 that face each other for the purpose of holding the lamp unit 1, and a base member 154 having holes 152 formed thereon for the passing of fixing elements, such as screws, and also a hole 153 formed thereon for the passing of a fixing rope. The curved surface 1511 of each clamp members 151 has a plurality of slots 1512 formed thereon for engaging the protruded stripes 10 on the outer cover of the lamp unit 1.

Within each lamp unit 1 of the lamp apparatus according to the present invention, there are provided a plurality of flash devices, such as Xenon tubes and ignition circuit devices, for controlling the ignition of the flash device. In a preferred embodiment of the lamp apparatus of the invention, each lamp unit 1 contains four Xenon tubes equipped therein as the flash device.

Figure 4:
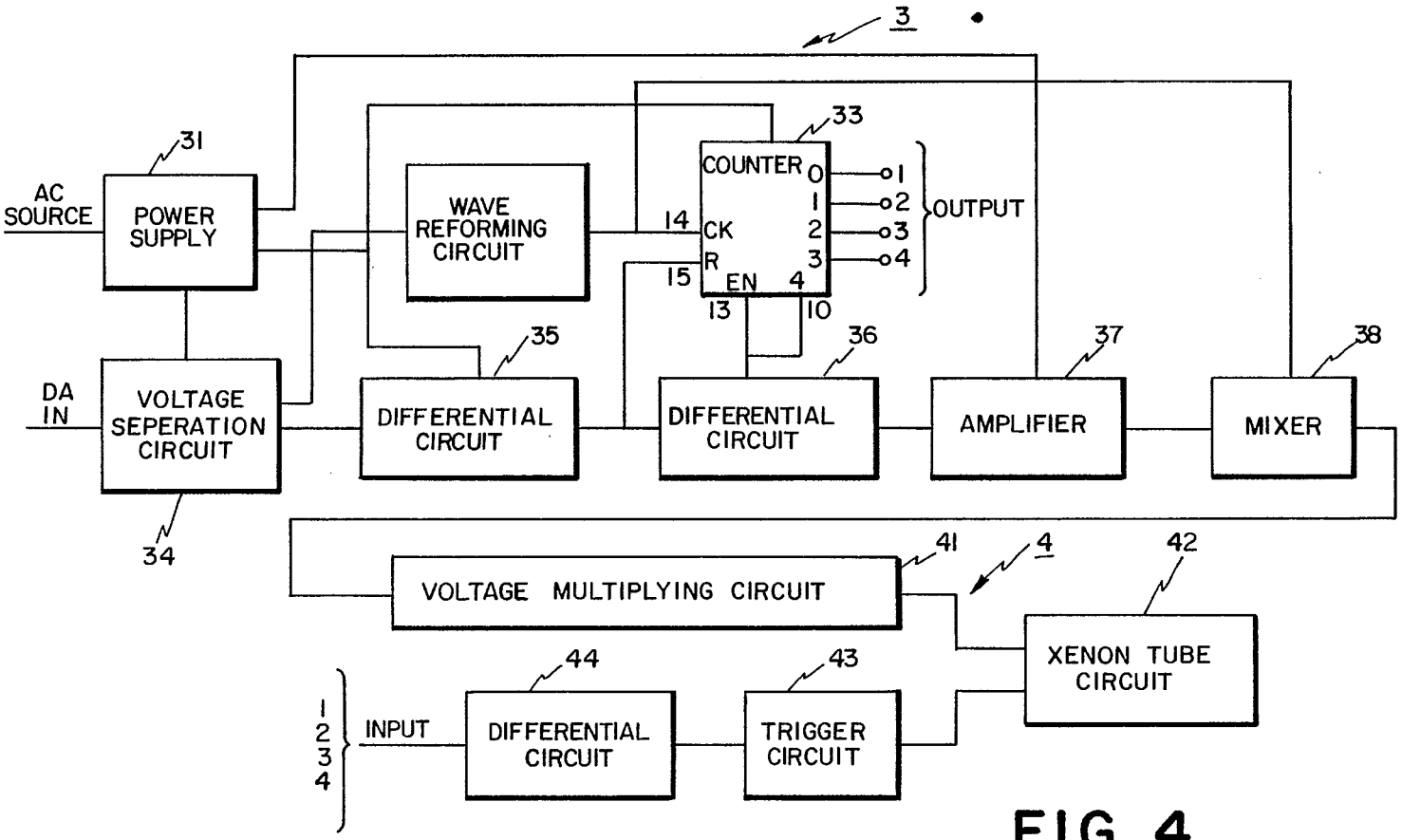
FIG. 4 is a block diagram of the electric circuit of the ignition circuit device in the lamp unit.
Figure 5A:
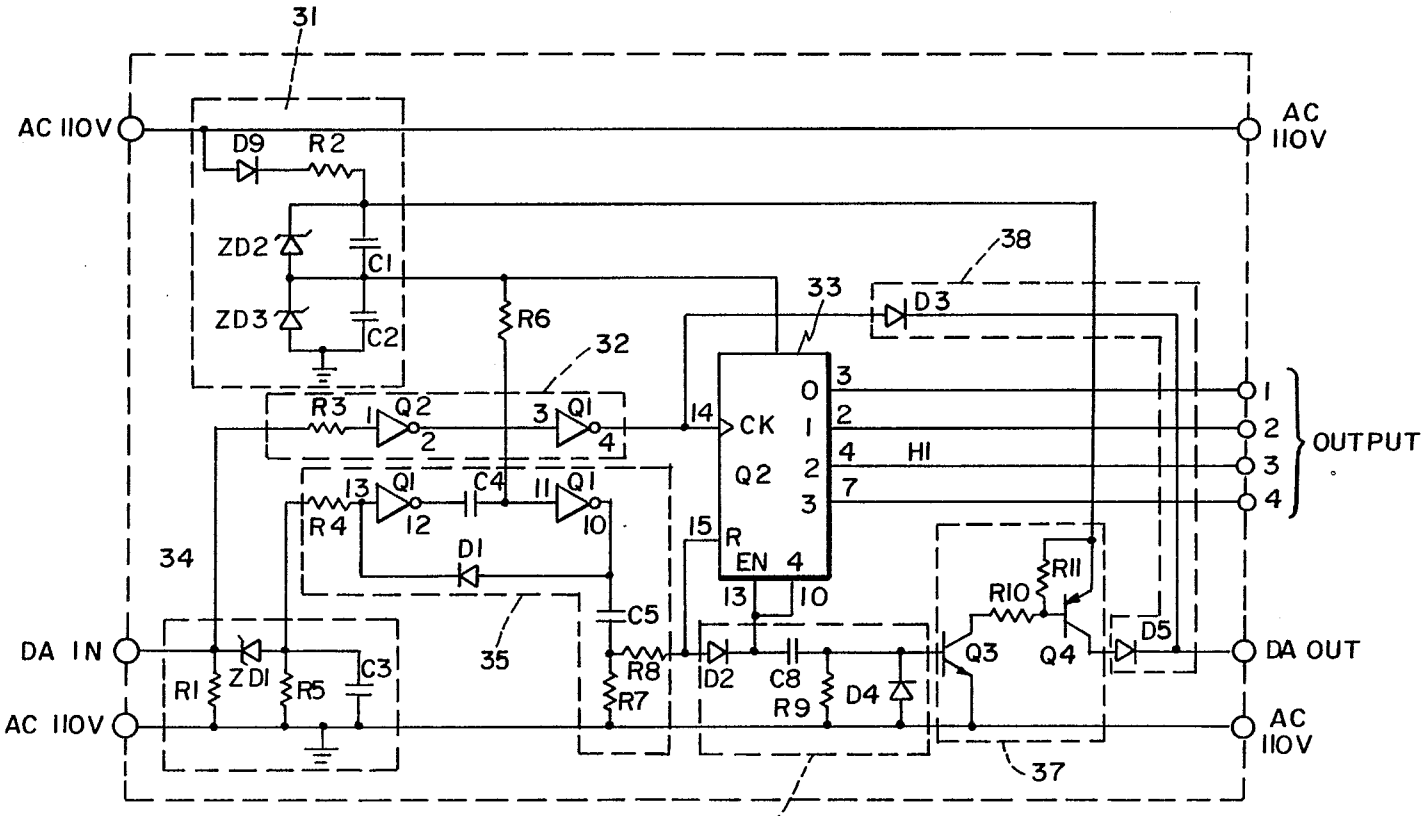
FIGS. 5 (*a*) and 5 (*b*) are electric circuit diagrams of the ignition circuit device in the lamp unit.
Figure 5B:
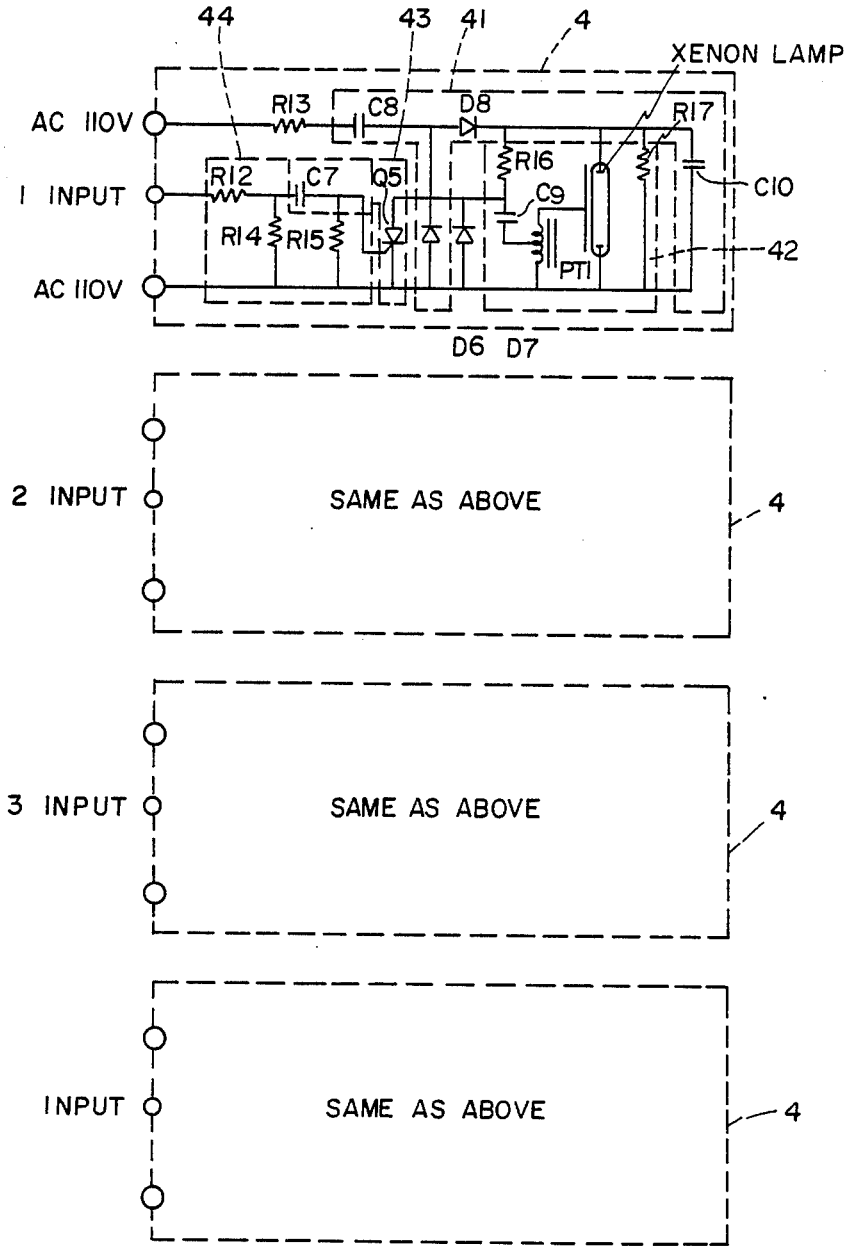

The block diagram of the ignition circuit device in the lamp unit for igniting the xenon tubes is shown in FIG. 4, and an embodiment of an electric circuit of the lamp unit corresponding to FIG. 4 is shown in FIG. 5 (*a*). As shown in FIGS. 4 and 5 (*a*), an AC power source provides an electric power to a power supply 31. The power supply 31 is composed of a diode D9, a resistor R2 in series with said diode D9, and then again in series connection to a pair of zener diodes ZD1, ZD2, each being in parallel to capacitors C1, C2 respectively. The first output of the power supply 31 is coupled to an amplifier 37 which substantially includes two resistors R10, R11 electrically connected with a pair of transistors Q3, Q4. The second output of the power supply 31 is connected to a counter 33 so as to count the number of pulse signals and is also electrically connected to a differential circuit 35. In addition, the third output of the power supply 31 is applied to a voltage separation circuit 34. Because the power supply 31 may supply a DC power of 12 or 24 volts, by means of the function of the voltage separation circuit 34 which includes a zener diode ZD1, resistors R1, R2, and a capacitor C3, a DC power of 12 V is delivered to a differential circuit 35, and a DC power of 24 v is delivered to a wave reforming circuit 32. The input terminal referred to as DAIN of the voltage separation circuit 34 can be obtained from the outputs of a driving circuit device which will be detailed hereinbelow with reference to FIGS. 6 and 7 or from the preceeding lamp unit. The outputs of voltage separation circuit 34 are respectively coupled to the wave reforming circuit 32 and the differential circuit 35.

The wave reforming circuit 32 includes a resistor R3 in series with a pair of Schmitt trigger inverter Q1, Q2 so as to reform the input waveform into a stable waveform, because the original waveform of the pulse signal is easily distorted and shifted due to long distance transmission and electric magnetic disturbance. The output signal of the wave reforming circuit 32 is delivered to pin 14 of the counter 33, and the output of the differential circuit 35 is also delivered to the counter 33. The counter 33 starts to count the number of pulse signals, and generates four sets of output signals coupled to the input of the differential circuit 44 needed for a lamp unit 1. It should be noted that the counter 33 must receive a DC 24 v power for actuating the same to start counting the number of pulse signals. Generally, the lamp apparatus is maintained at a DC 12 v level rather than at DC 24 v which is the level for creating a flashing lamp pattern. A differential circuit 36 receives the output signal of the differential circuit 35, and also the signals of from pin 13 and 10 of the counter 33. The differential circuit 35 includes resistors R4, R7, R8, inverters Q1, Q2, capacitors C4, C5, and a diode D1. The pin 15 of the counter 33 is connected to the electric line between the differential circuits 35, 36. The differential circuit 36 includes resistor R9, capacitor C8, and diodes D2, D4. An amplifier 37 receives the output signal of the differential circuit 36 and the power supply 31 so as to amplify the signal. Then, the signal is delivered to a mixer 38 to mix the signals from the wave reforming circuit 32 and the counter 33. The mixer 38 includes two diodes D3, D5. The voltage multiplying circuit 41 receives the signal from the mixer 38 and sends the signal out to a xenon tube circuit 42. The voltage multiplying circuit 41 can offer a desired voltage for allowing the actuation of the xenon tube circuit 42. In the mean time, the lamp unit accepts the input signal from a driving circuit device which will be described in detail hereinafter. The signal is delivered to the xenon tube circuit 42, passing through a differential circuit 44 and a trigger circuit 43.

Referring now to FIG. 5 (*b*), an electric circuit diagram of an ignition circuit 4 is illustrated. According to this invention, a lamp unit includes four bulbs each having an ignition circuit as shown in FIG. 5 (*b*). Referring also to FIG. 4, the ignition circuit 4 comprises a voltage multiplying circuit 41, a xenon tube circuit 42, a trigger circuit 43, and a differential circuit 44. When the voltage is applied to the voltage multiplying circuit 41 including diodes D6, D8, and capacitors C8, C10, the voltage is enhanced to 308 v from 110 v so as to actuate the ignition circuit. It should be noted that the diode D6 and capacitor C8 may be removed when the input voltage is an AC power of 220 v. The differential circuit 44, including resistors R12, R14, R15 and capacitors C7, can form the waveform needed for the trigger circuit 43. The xenon tube circuit 42 includes resistors R16, R17, C9 and a transformer PT. The secondary voltage of the transformer may deliver a power of 4.2 kv. The primary voltage of the transformer is connected to a discharge capacitor C9 so as to obtain the discharge current of the capacitor C9. The trigger circuit 43 comprises two capacitors C9, C7 and a transistor Q5. When transistor Q5 is on, the xenon tube is ignited to send out a flash. In such a way, four bulbs within each lamp apparatus according to this invention will be sequentially ignited according to the waveform of (f) to (i) in FIG. 8. Thus, the output waveform of each lamp unit is presented as the waveform of (j) in FIG. 8. When a flash of light is released from the xenon tube, a reverse voltage is applied to transistor Q5 cutting off the same. It is clear that the transformable speed of the pulse signal is very fast. Consequently, the design of various flashing patterns can be achieved by a connection in series of several sets of lamp units.

Figure 6:
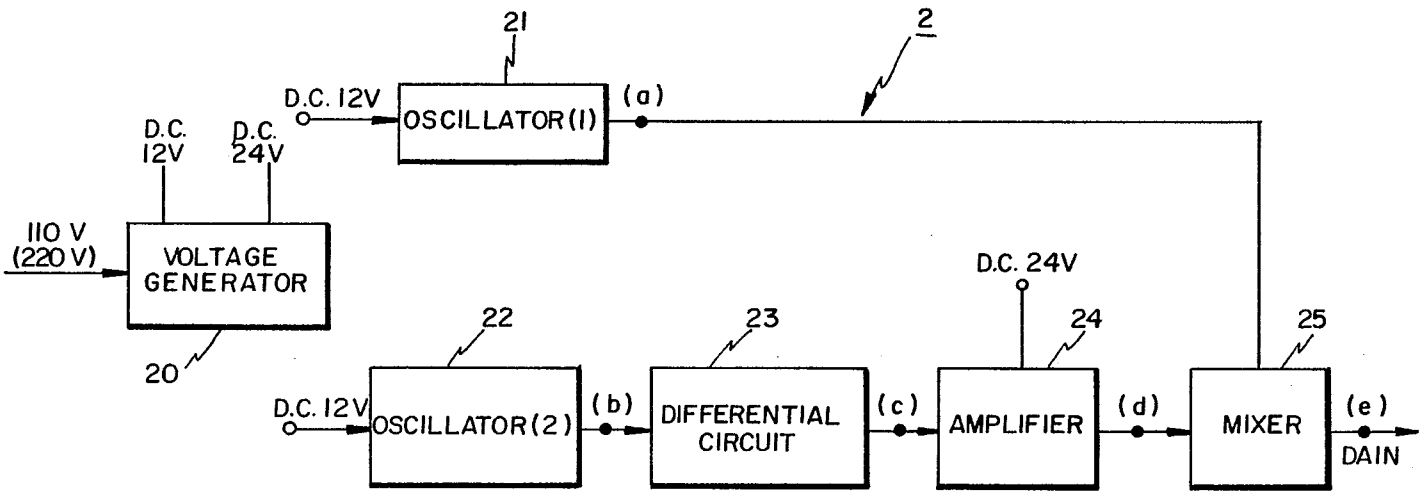
FIG. 6 is a block diagram of the electric circuit of the driving circuit device for the lamp apparatus.
Figure 8:
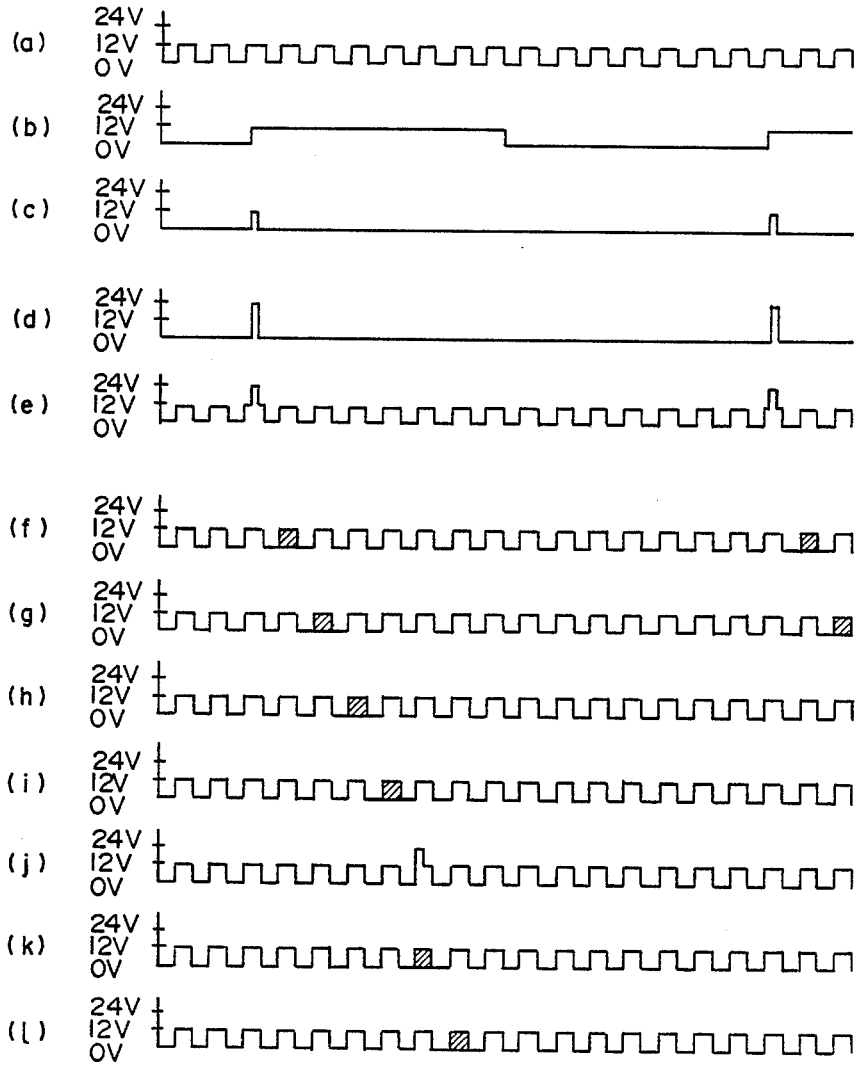
FIG. 8 is a waveform diagram of the voltage in various points of the driving circuit and the ignition circuit in the lamp apparatus according to the present invention.

Referring to FIG. 6, a driving circuit device for the lamp apparatus is illustrated. The driving circuit device 2 is arranged on the front end of the aforesaid lamp apparatus for driving said lamp apparatus. Referring also to FIG. 8, through a waveform diagram of the voltage output in various points, the conditions of the driving circuit and the ignition circuit in the lamp apparatus are presented. When an AC voltage is applied to a voltage generator 20, a DC power of 12 V or 24 V will be generated and supplied into the driving circuit device 3. In this way, an oscillator 21 receives a DC voltage of 12 v to generate a sequence of square waves as in the designated waveform of the (a) condition in FIG. 8. This figure shows that the waveform of (a) condition is a continuous square wave with a peak value of 12 v. Likewise, in another path, an oscillator 22 also receives a DC lower of voltage 12 v to generate a signal having a waveform shown as (b) condition waveform in FIG. 8. The output signal of the oscillator is delivered to a differential circuit 23 resulting in a pulse waveform which is the designated waveform of the (c) condition in FIG. 8. This pulse signal is a 12 volts signal . After that, the pulse signal is delivered to an amplifier 24 to which a DC 24 v is also being applied so as to result in the waveform of the (d) condition in FIG. 8. Except when the level of the signal raised to DC 24 v, the waveform of the (d) condition is same as that of the (c) condition. Finally, a mixer 25 receives the pulse signals from both the oscillators 21 and the amplifier 24 to generate the waveform which is the designated waveform of the (e) condition in FIG. 8 to serve as a trigger signal of the lamp apparatus of this invention.

Figure 7:
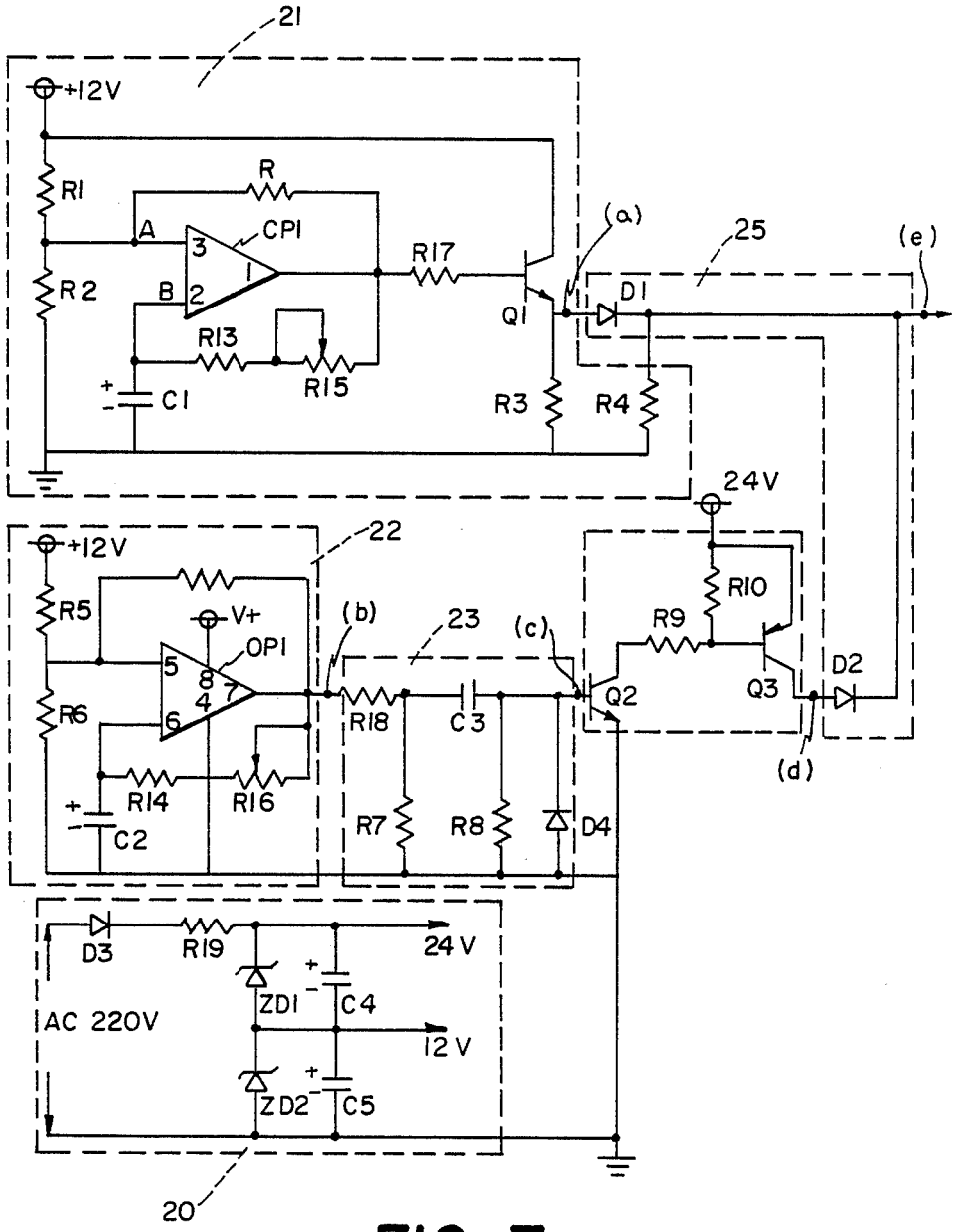
FIG. 7 is an electric circuit diagram of the driving circuit device for the lamp apparatus.

Referring still to FIGS. 6 and 7, the voltage generator 20 include a diode D3, a resistor R19, a pair of zener diodes ZD1, ZD2, and a pair of capacitors C4, C5. When an AC voltage of 110 or 220 is applied to the input of the voltage generator 20, a DC 12 v or DC 24 v power is generated due to the rectification effect of the diode D3. The oscillator 21 generally comprises resistors R1, R2, R11, R13, R17, variable resistor 15, a transistor Q1 and a comparator CP1. The oscillator 21 will generate a waveform of the (a) condition of FIG. 8 when a DC power of 12 v is applied to the input of the oscillator 21 causing the actuation of the comparator CP1 and transistor Q1. The oscillator 22 includes resistors R5, R6, R12, R14, a variable resistor R16, a capacitor C2 and an operational amplifier OP1. The oscillator 22 generates the waveform of the (b) condition of FIG. 8 due to the function of the operation amplifier. The differential circuit 23 comprising resistors R7, R8, R18, capacitor C3 and diode D4, is differentiated by the operational amplifier OP1 to generate the waveform of the (c) condition of FIG. 8. Also, the amplifying circuit 24 includes resistors R9, R10, and transistors Q2, Q3. Through the amplification of transistors Q2, Q3 as well as the input of a DC voltage of 24, it is certain that the signal pulse is enhanced to 24 v level as designated by the waveform in the (d) condition of FIG. 8. The mixer 25 including diodes D1, D2, will generate the waveform designated in the (e) condition of FIG. 8 when receiving signals both from the amplifying circuit 24 and the osillator 21.

While certain preferred embodiments have been described above, it will be readily apparent to those skilled in the art that a number of other modifications and changes can be made without departing from the scope of the invention.

What is claimed is:

1. A lamp apparatus for generating sequential flashes, comprising:

at least one lamp unit having a socket formed on a first end and a plug formed on a second end thereof, enabling connection between adjacent lamp units and a plurality of xenon tubes to be installed therein;

an ignition circuit device being provided in said lamp unit for starting the flashes of said plurality of xenon tubes within the lamp unit; and a main driving circuit device for controlling the flash sequence of the xenon tubes in the lamp apparatus.

2. A lamp apparatus as claimed in claim 1, further comprising a plurality of lamp units and a plurality of seat members for retaining said lamp units.

3. A lamp apparatus as claimed in claim 1, further comprising a plurality of lamp units and wherein each of said lamp units has an outer cover made of polycarbonate material, said lamp units being connected with one another in series.

4. A lamp apparatus as claimed in claim 3, wherein said outer cover has protruded stripes formed thereon for enhancing the reflective effect of the flashes generated by each lamp unit.

5. A lamp apparatus as claimed in claim 4, wherein said outer cover of said lamp unit comprises a positioning rim having two stoppers formed thereon and two recesses at the base portion thereof in alignment with said stoppers.

6. A lamp apparatus as claimed in claim 5, wherein said plug includes a body having a flange formed at a central portion thereof with a rubber ring sleeved thereon, a pair of hook members extending axially and surrounding the body, and an adapter having outer threads formed thereon.

7. A lamp apparatus as claimed in claim 2, wherein each said seat member is made of flexible material and comprises a pair of clamp members with curved surfaces that face each other for engaging the lamp unit.

8. A lamp apparatus as claimed in claim 1, wherein said ignition circuit device includes a power supply for supplying a power source, a wave reforming circuit for reforming the waveform into a stable waveform, a voltage separation circuit for generating two power voltages with different levels, differential circuits for transferring the signal waveform into a pulse signal, a counter for counting the number of pulse signals, an amplifier for amplifying the pulse signals, a mixer for mixing the signals from said wave reforming circuit and said amplifier, a voltage multiplying circuit for enhancing the voltage, and a trigger circuit for applying a signal to actuate said xenon tubes and a xenon tube circuit so as to cause said xenon tubes to generate various flashes of light.

9. A lamp apparatus as claimed in claim 8, wherein the driving circuit device comprises a voltage generator for supplying two voltages, a first oscillator and a second oscillator for generating two different square waves, a differential circuit for generating a pulse waveform, an amplifier for amplifying said signals and a mixer for mixing the signals from said first oscillator and said amplifier.

* * * * *